US010914025B2

(12) United States Patent
Kobayashi

(10) Patent No.: US 10,914,025 B2
(45) Date of Patent: Feb. 9, 2021

(54) SEWING-MACHINE OPERATING PROGRAM, SEWING MACHINE, AND TERMINAL DEVICE

(71) Applicant: Janome Sewing Machine Co., Ltd., Tokyo (JP)

(72) Inventor: Nobuhiko Kobayashi, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 288 days.

(21) Appl. No.: 16/023,122

(22) Filed: Jun. 29, 2018

(65) Prior Publication Data

US 2019/0003095 A1 Jan. 3, 2019

(30) Foreign Application Priority Data

Jul. 3, 2017 (JP) ..... 2017-130179

(51) Int. Cl.
*D05B 19/12* (2006.01)
*D05B 19/08* (2006.01)
*D05B 19/00* (2006.01)

(52) U.S. Cl.
CPC ..... *D05B 19/12* (2013.01); *D05B 19/006* (2013.01); *D05B 19/085* (2013.01); *D05D 2205/085* (2013.01)

(58) Field of Classification Search
CPC . D05B 19/12; D05B 19/085; D05D 2205/085
See application file for complete search history.

(56) References Cited

U.S. PATENT DOCUMENTS

2015/0045939 A1* 2/2015 Kongo ..... D05B 19/12 700/143
2018/0275749 A1* 9/2018 Yoon ..... G06F 3/011
2019/0003094 A1* 1/2019 Fujimoto ..... G05B 19/4183
2019/0030582 A1* 1/2019 Olsson ..... G05B 19/40938

FOREIGN PATENT DOCUMENTS

JP 2009-229 A 1/2009
JP 2009-39393 A 2/2009
JP 2012-200265 A 10/2012

* cited by examiner

*Primary Examiner* — Tajash D Patel
(74) *Attorney, Agent, or Firm* — Nath, Goldberg & Meyer; Jerald L. Meyer

(57) ABSTRACT

A sewing-machine operating program is installed in a terminal device of a user. A specifying information acquiring step causes a short-distance information acquiring unit to acquire specifying information recorded on a sewing-machine main unit. In the distance measuring step, an apart distance is calculated from a detection result of a movement detecting sensor with a position where the specifying information is acquired being as an initial position. In the distance comparing step, for a remote operation to the sewing-machine main unit, the apart distance and a prescribed distance are compared. In the function restricting step, when the apart distance is within the prescribed distance, an operation command is transmitted to the sewing-machine main unit via a wireless communication device, and when the apart distance exceeds the prescribed distance, the operation command is not transmitted to the sewing-machine main unit.

15 Claims, 12 Drawing Sheets

E2 E1 E3

| OPERATION NAME | RISK MANAGEABLE RANGE | | OUT-OF-RISK-MANAGEABLE RANGE |
|---|---|---|---|
| OPERATION NAME | RISK-MANAGEABLE INNER-BOUNDARY RANGE | RISK-MANAGEABLE OUTER-BOUNDARY RANGE | |
| STITCHWORK POSITION SLIGHT ADJUSTMENT (UNNECESSARY TO MOVE FRAME) | ENABLED WHEN SEWING IS NOT EXECUTED | | |
| MOVE TO SEWING START POINT | EXECUTED WITHOUT MESSAGE | DISPLAY MESSAGE AND EXECUTED | DISPLAY CHECK MESSAGE AND EXECUTED WHEN DISPLACEMENT IS WITHIN CERTAIN QUANTITY, DISPLAY ALERT AND DISABLED WHEN EQUAL TO OR GREATER THAN CERTAIN QUANTITY |
| MOVE SEWING START POINT (COLOR BLOCK UNIT) | EXECUTED WITHOUT MESSAGE | DISPLAY MESSAGE AND EXECUTED | DISPLAY ALERT AND DISABLED |
| MOVE SEWING START POINT (JUMP BY SPECIFYING NUMBER OF STITCHES) | EXECUTED WITHOUT MESSAGE | DISPLAY MESSAGE AND EXECUTED | DISPLAY ALERT AND DISABLED |
| MOVE FRAME BY JOG KEY | EXECUTED WITHOUT MESSAGE | DISPLAY MESSAGE AND EXECUTED | DISPLAY ALERT AND DISABLED |
| MOVE FRAME IN ACCORDANCE WITH CHANGE IN PATTERN DISPLACEMENT IN TERMINAL DEVICE | EXECUTED WITHOUT MESSAGE | DISPLAY MESSAGE AND EXECUTED | DISPLAY ALERT AND DISABLED |
| CHECK SEWING RANGE | EXECUTED WITHOUT MESSAGE | DISPLAY MESSAGE AND EXECUTED | DISPLAY CHECK MESSAGE AND EXECUTED IN THE CASE OF SMALL FRAME, DISPLAY ALERT AND DISABLED IN THE CASE OF LARGE FRAME |
| BASTING ACTION (BASTING ON EXTERNAL SIDE OF STITCHWORK PATTERN RANGE) | DISABLED SINCE INVOLVING NEEDLE BAR ACTUATION | | |
| MOVE FRAME (FOUR CORNERS AND RETAINING POSITION) | EXECUTED WITHOUT MESSAGE | DISPLAY MESSAGE AND EXECUTED | DISPLAY ALERT AND DISABLED |
| START SEWING | DISABLED SINCE INVOLVING NEEDLE BAR ACTUATION | | |
| SUSPEND SEWING | ENABLED, BUTTON NOT DISPLAYED IN DEFAULT | ENABLED, BUTTON IN NORMAL SIZE IS DISPLAYED ON SCREEN | ENABLED, LARGE SUSPEND BUTTON IS DISPLAYED ON SCREEN (FOR EMERGENCY SUSPEND) |
| CHECK BOBBIN THREAD REMAINING AMOUNT | ENABLED WHEN SEWING MACHINE IS NOT SEWING STITCHWORK | | |
| MOVE UP AND DOWN HOLDER | ENABLED WHEN SEWING MACHINE IS NOT SEWING STITCHWORK | | |
| CUT THREAD | EXECUTED WITHOUT CHECK MESSAGE WHEN SEWING MACHINE IS NOT SEWING STITCHWORK | DISPLAY CHECK MESSAGE AND EXECUTED WHEN SEWING MACHINE IS NOT SEWING STITCHWORK | DISABLED SINCE INVOLVING NEEDLE BAR ACTUATION |
| MONITORING OF ACTION STATUS | ENABLED | | |

*FIG. 10*

SEWING-MACHINE OPERATING PROGRAM, SEWING MACHINE, AND TERMINAL DEVICE

CROSS-REFERENCE TO RELATED APPLICATION

This application is based upon and claims the benefit of priority from Japan Patent Application No. 2017-130179, filed on Jul. 3, 2017, the entire contents of which are incorporated herein by reference.

FIELD OF THE INVENTION

The present disclosure relates to an operation of a sewing machine using a terminal device.

BACKGROUND

In recent years, computers have become downsized and portable. Moreover, the performance of computers has been increasing, large-capacity wireless-communication technologies are now available, and a development environment for applications can be easily prepared. This enables a user to sophisticatedly operate a device using a terminal device carried by the user without an installation of a high-performance man-machine interface at the device to be operated. On the premise of the utilization of the terminal device in which an application is installed, there are example cases in which the man-machine interface at the device side is simplified, and the man-machine interface at the device side is eliminated.

A large number of proposals have been made to transmit and receive data by connecting a sewing machine to other computer devices (e.g., JP2009-39393A and JP2012-200265A). That is, in view of technology, there is no difference between a sewing machine and other devices to be operated. Even if the sewing machine is provided with a simple man-machine interface only, or even if the sewing machine is not provided with the man-machine interface, it is possible to provide an advanced operation environment to a sewing machine by a terminal device.

However, the difference between a sewing machine from other devices is that the sewing machine is an apparatus that forms a seam by reciprocating a needle, or horizontally moves a stitchwork frame on which a sewing object, such as a cloth or a leather, is stretched. That is, the sewing machine moves mechanical components, such as the stitchwork frame and the needle, and such moving mechanical components are exposed to the exterior. Hence, it is preferable that the operator always stay near the sewing machine for possible risk avoidance action. However, the operation environment for the sewing machine using the terminal device enables the operator to leave from the sewing machine, resulting in a possibility such that the user leaves away from the sewing machine to a place where the risk avoidance action cannot be performed.

In particular, in a homeplace, the family members are not only adults who are capable of taking a risk avoidance action. Children, etc., who lack the recognition ability of risk, or who lack the risk avoidance capability are also the family members. Hence, according to home-use sewing machines, indeed, a technology of causing the operator to thoroughly stay near the sewing machine has been proposed (e.g., JP2009-229A).

According to the technology disclosed in JP2009-229A, a terminal device that has identification information for permitting an operation to the sewing machine is held by an adult. Identification information is transmitted to the sewing machine by RFID that is a short-range wireless communication technology having a transmittable and receivable range that is 1 mat maximum. The sewing machine permits an operation to sewing machine during the identification information permitting the operation to the sewing machine is being received. In contrast, when the identification information permitting the operation to the sewing machine is no longer received, the sewing machine sets up an actuation prohibiting mode, thereby prohibiting the actuation of a sewing-machine motor, and giving an alert.

As described above, according to the technology of JP2009-229A, when there is no adult qualified as an operator near the sewing machine, the sewing machine cannot be operated and when such an adult leaves the sewing machine, the sewing machine is deactivated.

As for sewing machines, although there is an idea for providing an operation environment by a terminal device, in view of the safety, a management scheme of avoiding a risk generation factor itself has been adopted. Hence, the kind of operation that can be given to the sewing machine using the terminal device are limited to displaying the status of the sewing machine, and operation to transmit stitchwork data to the sewing machine. That is, operations involving a drive of the mechanical components, such as the stitchwork frame and the needle, are forced into forbidden.

The present disclosure has been proposed in order to address the above technical problems of conventional technologies, and an objective is to provide a sewing-machine operating program, a sewing machine, and a terminal device which improve the usability of a sewing machine for an operator by enabling the operator to drive the mechanical components of the sewing machine via the terminal device under a risk management that ensures a certain safety.

SUMMARY OF THE INVENTION

In order to achieve the above objective, a sewing-machine operating program according to a first aspect of the present disclosure causes a terminal device that comprises an operating unit to execute:

a distance measuring step of calculating an apart distance of the terminal device from a sewing machine;

a distance comparing step of comparing the apart distance with a prescribed distance set beforehand from the sewing machine; and a function restricting step of restricting a function of a remote operation via the operating unit to the sewing machine in accordance with a comparison result in the distance comparing step.

The terminal device may further comprise:

an information acquiring unit that acquires specifying information recorded on the sewing machine; and a movement detecting sensor that detects a movement of the terminal device, and in the distance measuring step, the apart distance may be calculated from a detection result of the movement detecting sensor with a position where the information acquiring unit acquires the specifying information being as a position of the sewing machine.

The information acquiring unit may be a camera or a short-distance wireless communication device, and the specifying information may be indicated as a bar code, a two-dimensional code, or an RFID tag provided on the sewing machine.

The sewing-machine operating program may further comprise a communication establishing step of establishing a communication between the sewing machine and the terminal device based on the specifying information when the information acquiring unit acquires the specifying information.

The terminal device may further comprise a communication unit, and in the function restricting step, when the apart distance is within the prescribed distance, a command corresponding to the remote operation may be transmitted to the sewing machine via the communication unit, and when the apart distance exceeds the prescribed distance, a command corresponding to the remote operation may be not transmitted to the sewing machine.

The terminal device may further comprise a communication unit, the prescribed distance may comprise a first prescribed distance and a second prescribed distance shorter than the first prescribed distance, and in the function restricting step, when the apart distance exceeds the first prescribed distance, a command corresponding to the remote operation may be not transmitted to the sewing machine, when the apart distance is within the first prescribed distance and exceeds the second prescribed distance, after an alert to the remote operation is given, a command corresponding to the remote operation may be transmitted to the sewing machine via the communication unit, and when the apart distance is within the second prescribed distance, a command corresponding to the remote operation may be transmitted to the sewing machine via the communication unit.

In the distance comparing step, the apart distance may be compared with an alert distance shorter than the prescribed distance, and the sewing-machine operating program may further cause the terminal device to execute an alerting step of giving an alert when the apart distance becomes equal to or larger than the alert distance.

Moreover, in order to achieve the above objective, a sewing machine according to a second aspect of the present disclosure comprise a terminal device, in which the terminal device comprises:

an operating unit in which a remote operation to the sewing machine is input;

a distance measuring unit that calculates an apart distance from the sewing machine;

a distance comparing unit that compares the apart distance with a prescribed distance that is set beforehand from the sewing machine; and a function restricting unit that restricts a function of the remote operation via the operating unit in accordance with a comparison result by the distance comparing unit.

The terminal device may further comprise:

an information acquiring unit that acquires specifying information recorded on the sewing machine; and a movement detecting sensor that detects a movement of the terminal device, and the distance measuring unit calculates the apart distance from the detection result of the movement detecting sensor with the position where the information acquiring unit acquires the specifying information being as a position of the sewing machine.

The information acquiring unit may be a camera or a short-distance wireless communication device, and the specifying information may be indicated as the bar code, the two-dimensional code, or the RFID tag provided on the sewing machine.

The sewing machine and the terminal device may comprise respective communication control units that establish a communication between the sewing machine and the terminal device based on the specifying information when the information acquiring unit acquires the specifying information.

Furthermore, in order to achieve the above objective, a terminal device according to a third aspect of the present disclosure comprise:

an operating unit in which a remote operation to a sewing machine is input;

a distance measuring unit that calculates an apart distance from the sewing machine;

a distance comparing unit that compares the apart distance with a prescribed distance that is set beforehand from the sewing machine; and a function restricting unit that restricts a function of the remote operation via the operating unit in accordance with a comparison result by the distance comparing unit.

The terminal device may further comprise:

an information acquiring unit that acquires specifying information recorded on the sewing machine; and a movement detecting sensor that detects a movement of the terminal device, in which the distance measuring unit may calculate the apart distance from the detection result of the movement detecting sensor with the position where the information acquiring unit acquires the specifying information being as a position of the sewing machine.

The information acquiring unit may be a camera or a short-distance wireless communication device, and the specifying information may be indicated as the bar code, the two-dimensional code, or the RFID tag provided on the sewing machine.

The terminal device may further comprise a communication control unit that establishes a communication between the sewing machine and the terminal device based on the specifying information when the information acquiring unit acquires the specifying information.

According to the present disclosure, the positional relationship between the risk manageable range with the sewing machine as a base point and the operator can be grasped, enabling a restriction on an operation function to the sewing machine based on whether the operator is within the risk manageable range or out of such a range. Hence, a risk management that assures a certain safety even if the mechanical components of the sewing machine are actuated is enabled, and an advanced operating environment for the sewing machine using the terminal device is provided.

BRIEF DESCRIPTION OF THE DRAWINGS

FIG. 10 is an exemplary diagram illustrating an operation kind list;

DETAILED DESCRIPTION OF THE EMBODIMENTS

First Embodiment

Figure 1:
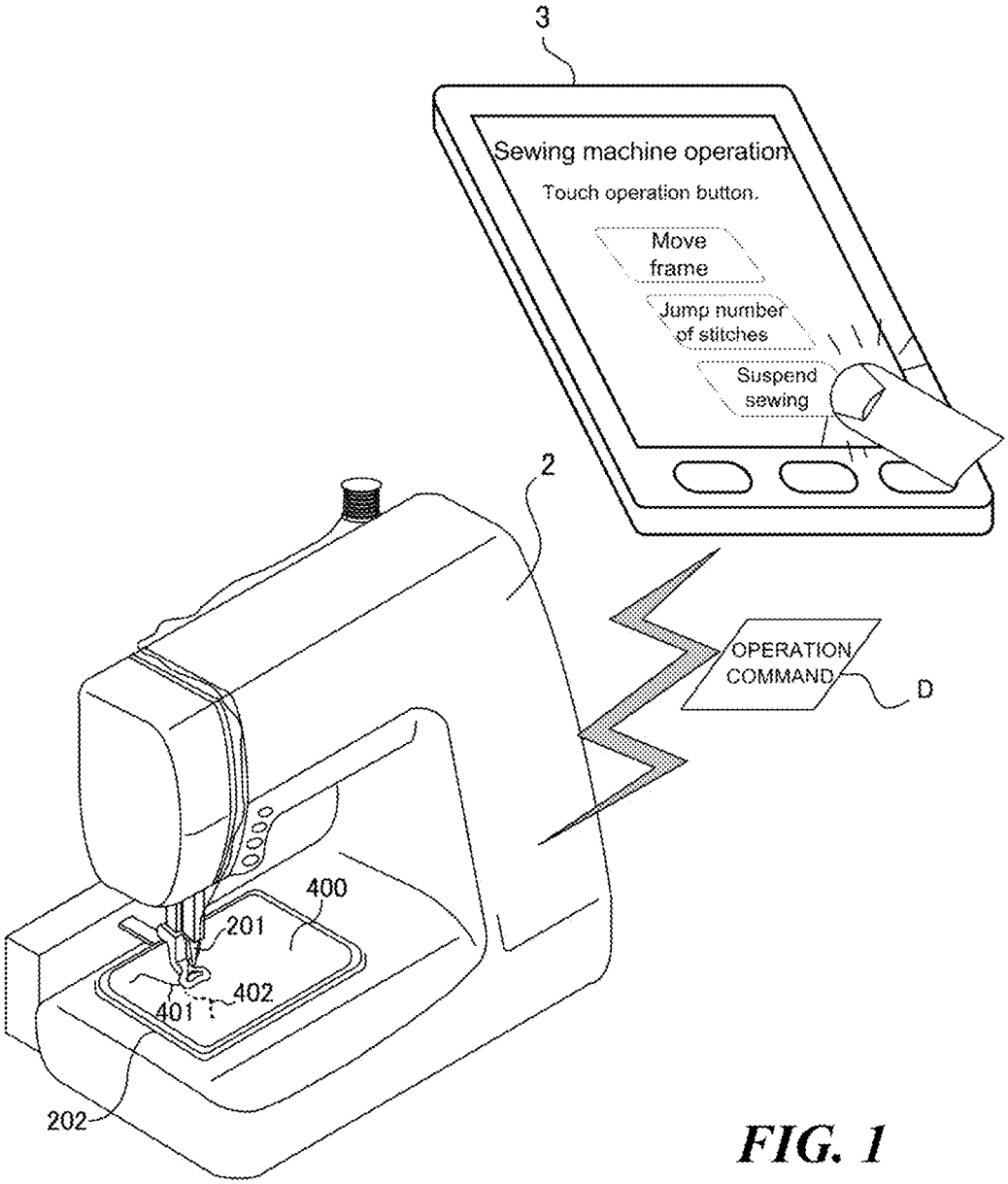
FIG. 1 is an exemplary diagram illustrating an external appearance of a sewing machine.
Figure 2:
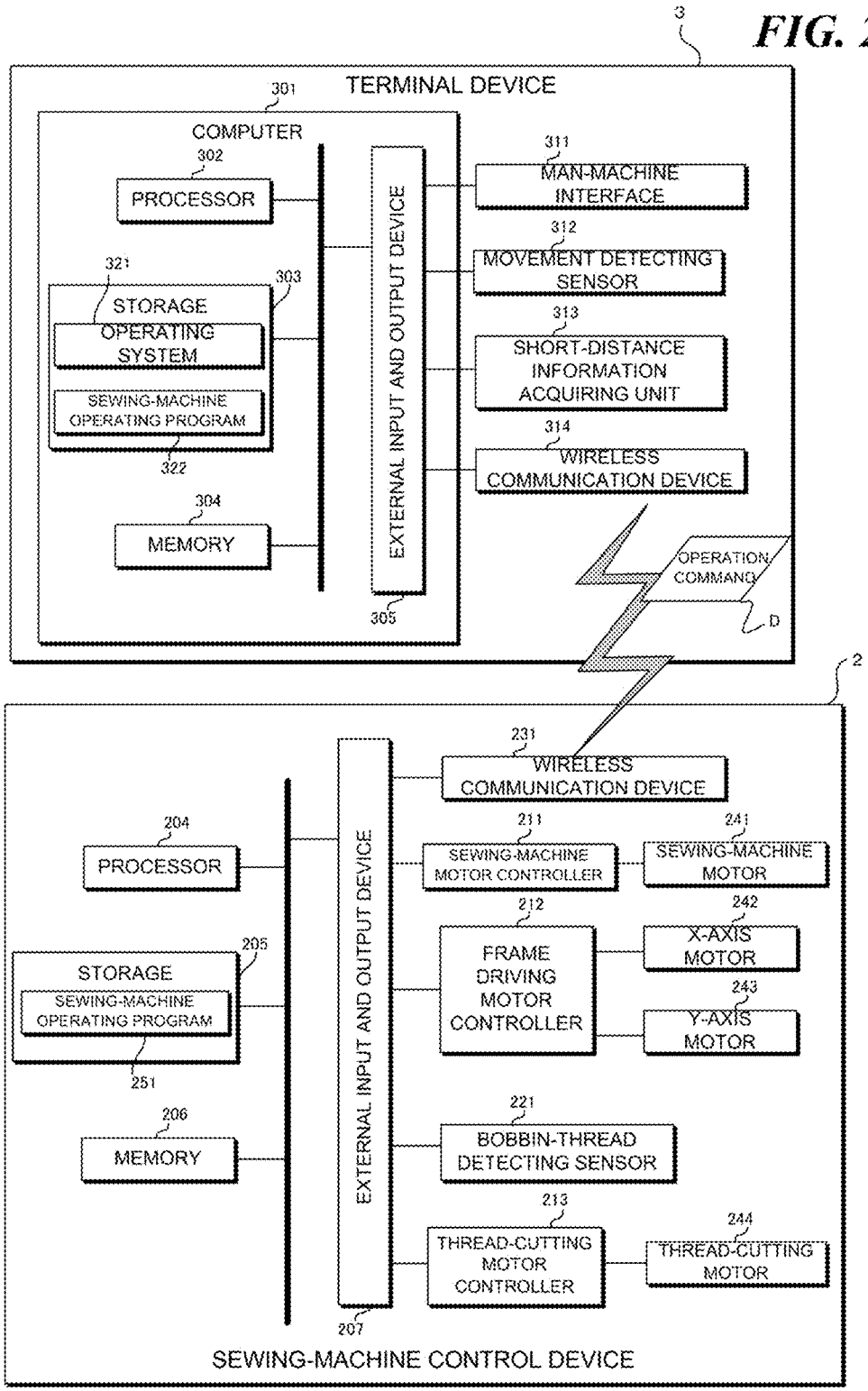
FIG. 2 is a block diagram illustrating a hardware configuration with respect to a control on the sewing machine.

FIG. 1 is an exemplary diagram illustrating an external appearance of a sewing machine. FIG. 2 is a block diagram illustrating a hardware configuration with respect to a control on the sewing machine. As illustrated in FIGS. 1 and 2, a sewing machine 1 includes a sewing-machine main unit 2 and a terminal device 3. The sewing-machine main unit 2 is a stationary unit. The terminal device 3 is possessed by an operator who carries out a sewing work using the sewing-machine main unit 2.

As long as the operator is within a risk manageable range with the sewing-machine main unit 2 as a base point, the operator is permitted to operate the sewing-machine main unit 2 while moving freely. That is, wireless connection is established between the sewing-machine main unit 2 and the terminal device 3, and data can be transmitted and received therebetween. The terminal device 3 serves as a man-machine interface 311 to operate the sewing-machine main unit 2, and the sewing-machine main unit 2 is driven in accordance with the operation input to the terminal device 3 as long as the terminal device 3 is located within the risk manageable range. The risk manageable range is a range that enables the operator to visually check the sewing-machine main unit 2, to notice an abnormal change or a possibility thereof, and to quickly return to the sewing-machine main unit 2, and is, for example, less than 5 m.

The sewing-machine main unit 2 is a home, professional, or industrial apparatus that sews a sewing object 400, such as a cloth or a leather. This sewing-machine main unit 2 reciprocates a needle 201 in the axial direction to insert or remove the needle 201 relative to the sewing object 400, such as a cloth or a leather, causing a needle thread 401 and a bobbin thread 402 to be intertwined, thereby forming a seam. The sewing-machine main unit 2 includes a stitchwork frame 202 that holds the sewing object 400. The stitchwork frame 202 holds the stretched sewing object 400, and moves on a plane in parallel with a plane across which the sewing object 400 is stretched.

Moreover, the sewing-machine main unit 2 includes a built-in control device that controls the reciprocation motion of the needle 201, and the planar movement of the stitchwork frame 202. The control device mainly includes a so-called computer. The term computer is a concept involving a micro-computer, and includes a processor 204 also called a CPU or an MPU, a non-volatile storage 205, such as an HDD, an SSD or a flash memory for storing programs and data, a memory 206 which is also called a RAM and which serves as a work area for the processor 204, and an external input and output device 207 which is also called an I/O and which serves as an input and output port with an external peripheral device. Moreover, the control device includes a sewing-machine motor controller 211, a frame drive motor controller 212, a thread-cutting motor controller 213, various sensors like a bobbin-thread detecting sensor 221, and a wireless communication device 231, all connected to the external input and output device 207.

The storage 205 stores therein a sewing-machine-side control program 251. The processor 204 in accordance with the sewing-machine-side control program 251 reads an operation command transmitted from the terminal device 3, outputs control signals to the sewing-machine motor controller 211, the frame drive motor controller 212, and the thread-cutting motor controller 213 in accordance with the operation command, and receives detection signals from the various sensors, and transmits such signals to the terminal device 3.

The sewing-machine motor controller 211 is connected, via signal lines, to a sewing-machine motor 241 that is a drive source for reciprocating the needle 201. In response to the control signals from the processor 204, this sewing-machine motor controller 211 rotates the sewing-machine motor 241 at the rotation speed indicated by the control signals, or suspends the sewing-machine motor 241. The frame drive motor controller 212 is connected, via signal lines, to an X-axis motor 242 and a Y-axis motor 243 that are the drive sources for moving the stitchwork frame on a plane. This frame drive motor controller 212 drives, in response to the control signals from the processor 204, the X-axis motor 242 and the Y-axis motor 243 by a displacement amount indicated by the control signals.

The thread-cutting motor controller 213 is connected, via signal lines, to the motor of a thread cutting device that cuts threads when a thread is replaced. This thread-cutting motor controller 213 drives, in response to the control signals from the processor 204, the motor of the thread cutting device. The bobbin-thread detecting sensor 221 outputs signals containing the remaining amount information on the bobbin thread 402 to the processor 204. The various sensors also transmit signals containing detection information to the processor 204.

The wireless communication device 231 includes an antenna, a modulator, a demodulator, a D-A converter and an A-D converter, generates radio waves on which data is superimposed, transmits such radio waves to the terminal device 3, or takes out the data from the radio waves output by the terminal device 3, thereby transmitting and receiving the data. For example, the wireless communication device 231 is capable of transmitting and receiving the data in compliance with network or peer-to-peer communication standards, such as WiFi, WiFiDirect, Bluetooth (registered trademark), ZigBee (registered trademark), UWB and WirelessUSB, in each layer.

The terminal device 3 mainly includes a so-called computer 301, and includes the man-machine interface 311, a movement detecting sensor 312, a short-distance information acquiring unit 313, and a wireless communication device 314. The terminal device 3 is applicable regardless of whether it is general-purpose or special-purpose, and example general-purpose devices are a commercially available smart phone, tablet computer, hand-held computer, laptop computer, and wearable device. An example special-purpose device is the remote controller of the sewing-machine main unit 2. The remote controller of the sewing-machine main unit 2 includes an operation panel which is attached to a columnar part of the sewing-machine main unit 2, is detachable therefrom, is physically connected by a connector when attached to the sewing-machine main unit 2, and is capable of directly operating the sewing-machine main unit 2 via signal lines.

The computer 301 includes a processor 302, a storage 303, a memory 304, and an external input and output device 305. The man-machine interface 311, the movement detecting sensor 312, the short-distance information acquiring unit 313, and the wireless communication device 314 are connected to the external input and output device 305. The wireless communication device 314 transmits and receives data like an operation command to the sewing machine in compliance with a communication standard compatible with the wireless communication device 231 of the sewing-machine main unit 2.

Installed in the storage 303 are an operation system 321 and a sewing-machine operating program 322. The sewing-machine operating program 322 is program codes or a control program that causes the terminal device 3 to operate as the man-machine interface 311 for the sewing-machine operation, and is, more specifically, object codes or machine language instructions.

This sewing-machine operating program 322 is stored in a transportable storage medium or a storage medium like a server on the Internet or a LAN so as to be distributable. Example transportable storage media are a DVD-ROM, an SD card, and a USB memory. When the program is stored in the transportable storage medium or the server, the program may be written in various source code programming languages, and when installed in the storage, the program may be compiled or assembled into executable machine codes or commands suitable for the processor, or may be executed by an interpreter, and may be built in the operating system 321.

Example man-machine interface 311 are a touch-panel screen, a monitor and a keyboard, or a monitor and a pointing device, output an operation screen so as to enable the operator to visually check, and receive the operation given by the operator. Any movement detecting sensor 312 is applicable as long as the displacement amount and the movement direction for a certain time period are measurable inside a building, etc., and for example, an accelerometer and a gyro sensor are applicable.

The short-distance information acquiring unit 313 is a device capable of acquiring information when the distance from the information providing side is a short distance like less than 1 m, and is, for example, a camera that reads a bar code or a two-dimensional code or an RFID reader that utilizes a non-contact communication technology. Note that the term short distance is a distance relationship between the operator who sits down in front of the sewing machine and is directly operating the sewing machine and such a sewing machine, and a distance such that the operator can reach the sewing machine when extending the operator's arm is desirable. Hence, in a camera, it is unnecessary to activate the zoom function in both optical and digital types.

Figure 3:
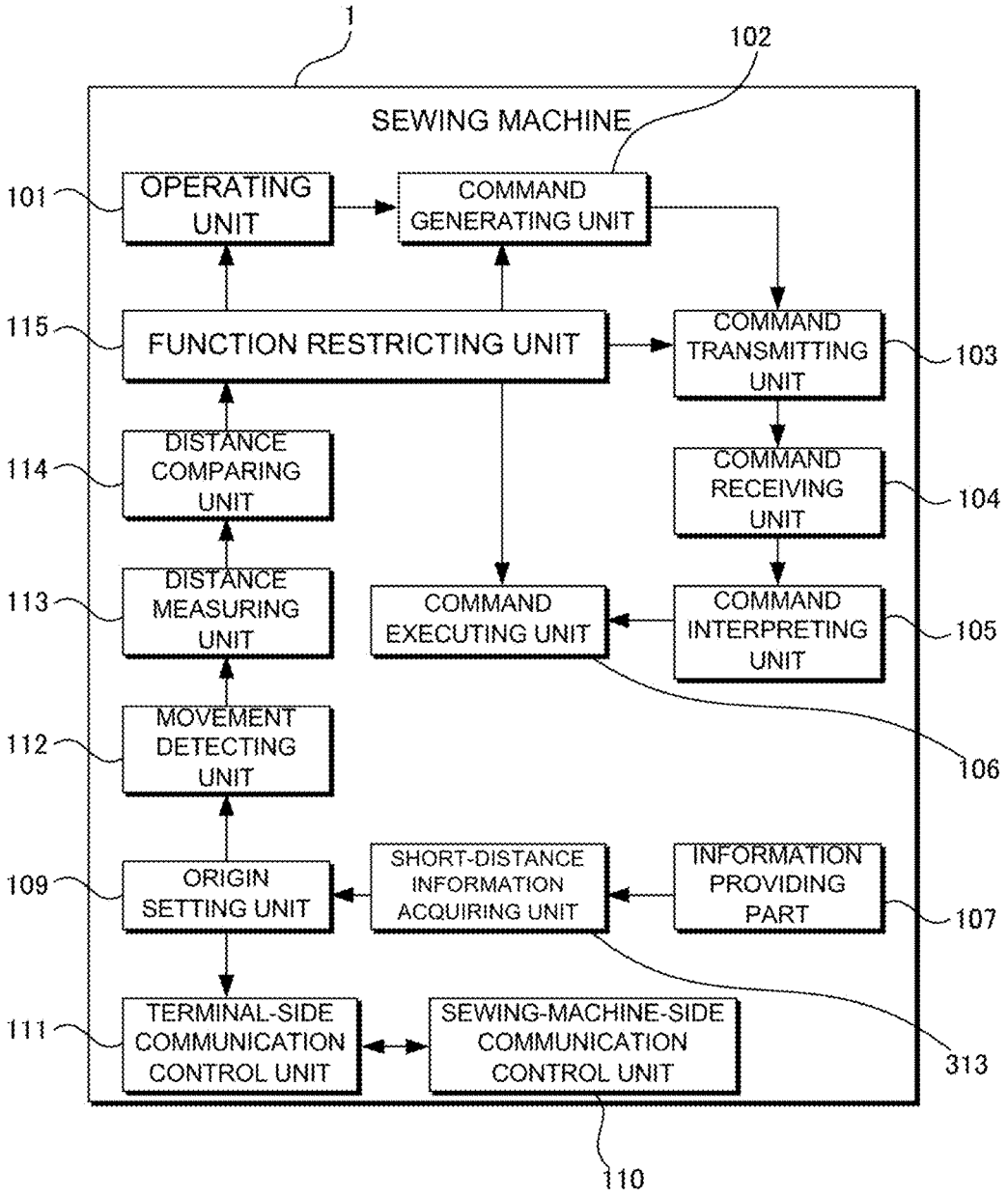
FIG. 3 is a block diagram illustrating a functional structure of the sewing machine.

FIG. 3 is a block diagram illustrating the structure of the sewing machine in which the sewing-machine operating program 322 is executed on the terminal device 3, and the sewing-machine-side control program 251 is executed on the sewing-machine main unit 2. As illustrated in FIG. 3, the sewing machine 1 includes an operating unit 101, a command generating unit 102, a command transmitting unit 103, a command receiving unit 104, a command interpreting unit 105, a command executing unit 106, an information providing part 107, the short-distance information acquiring unit 313, an origin setting unit 109, a sewing-machine-side communication control unit 110, a terminal-side communication control unit 111, a movement detecting unit 112, a distance measuring unit 113, a distance comparing unit 114, and a function restricting unit 115.

The operating unit 101 includes the man-machine interface 311 of the terminal device 3, displays operation buttons to the sewing-machine main unit 2, receives a depress of the operation button, and displays various information including an alert, etc. The command generating unit 102 includes the processor 302 of the terminal device 3, and generates a command corresponding to the operation received by the operating unit 101. When, for example, an operation to jump the number of stitches is received, a command containing a command parameter indicating a jump and a numerical parameter indicating the number of stitches is generated. The command is a data string with a specific length, and the kinds of parameters that can be contained at each position and each range in the data string are defined beforehand.

The command transmitting unit 103 includes the wireless communication device 314 of the terminal device 3, adds an IP address or an SSID of the sewing-machine main unit 2 to the command generated by the command generating unit 102, superimposes such information on carrying waves, and transmits the carrying waves to the sewing machine. The command receiving unit 104 includes the wireless communication device 231 of the sewing-machine main unit 2, receives the transmission data containing the IP address or the SSID of the sewing-machine main unit 2, and takes out the command from the carrying waves.

The command interpreting unit 105 includes the processor 204 of the sewing-machine main unit 2, and interprets the command received by the command receiving unit 104. The command executing unit 106 includes the processor 204 of the sewing-machine main unit 2, and transmits control signals to each unit in accordance with the interpreting result of the command. In the case of, for example, a jump command, the control signals are transmitted to the stitchwork frame 202 in such a way that the needle is located at the position where a seam is formed with the number of stitches indicated by the contained numerical parameter.

The function restricting unit 115 restricts the operation to the sewing-machine main unit 2 in accordance with the positional relationship between the terminal device 3 and a risk manageable range E1. That is, an operation in a first group is permitted even if the terminal device 3 is within the risk manageable range E1 (see FIG. 9) or is out of such a region, an operation in a second group is permitted when within the risk manageable range E1, but when the terminal device 3 is out of the risk manageable range E1, the function restricting unit 115 interrupts and the operation is not realized, and the function restricting unit 115 suspends the action of the sewing machine executed in accordance with the operation in the second group.

The grouping of the operation is optional in accordance with a policy. For example, the first group is an operation that does not move the mechanical component of the sewing machine, and is an operation of displaying the status of the sewing machine, detecting the remaining amount of the bobbin thread 402, and taking stitchwork data, etc. Moreover, the second group is, for example, an operation of moving the mechanical component of the sewing-machine main unit 2 other than the needle 201, and having a little displacement. Examples of such an operation are minor movement of the stitchwork frame 201 and a lifting up and down of a presser foot. As for the movement of the needle 201, this operation may be in a third group not displayed in the operation menu of the operating unit 101 and not accepted at all.

When, for example, the terminal device 3 is out of the risk manageable range, the function restricting unit 115 may change the operation button for the second group so as not to be displayed, cause the operation button for the second group to be grayed out so as to be invalidated, end the process at the terminal-device-3 side before the command is generated, end the process at the terminal-device-3 side before the command is transmitted to the sewing-machine main unit 2, or end the process at the sewing-machine-main-unit-2 side before the command is executed when the interpreting result of the command indicates the operation in the second group. The function restricting unit 115 includes the processor 302 of the terminal device 3 when interrupting the operating unit 101, the command generating unit 102, and the command transmitting unit 103.

Moreover, the function restricting unit 115 includes the processors 204 of the sewing-machine main unit 2 when interrupting the command executing unit 106. Still further, when the terminal device 3 is out of the risk manageable range E1, and there is an action of the sewing-machine main unit 2 executed upon the operation in the second group, the function restricting unit 115 suspends this action. When the terminal device 3 is provided with the function restricting unit 115, the function restricting unit 115 generates a suspend command, and transmits this command to the sewing-machine main unit 2. The command executing unit of the sewing machine receives this suspend command, and outputs suspend signals to the corresponding driving and control unit.

Although this function restricting unit 115 restricts the function in accordance with the positional relationship between the terminal device 3 and the risk manageable range E1, or releases the function, the positional relationship between the terminal device 3 and the risk manageable range E1 is determined by the movement detecting unit 112, the distance measuring unit 113, and the distance comparing unit 114.

The movement detecting unit 112 includes the acceleration sensor and gyro sensor of the terminal device 3. This movement detecting unit 112 performs sampling on the movement direction and the displacement amount, i.e., the acceleration vector. The distance measuring unit 113 accumulates each acceleration vector having undergone the sampling by the movement detecting unit 112. The distance comparing unit 114 compares the accumulated value by the distance measuring unit 113 and the risk manageable range E1, and outputs the magnitude information on the accumulated value relative to the risk manageable range E1. The function restricting unit 115 restricts the operation in the second group in accordance with this magnitude information. When the accumulated value is smaller than the risk manageable range E1, the operation in the second group is permitted, and when the accumulated value is larger than the risk manageable range E1, the operation in the second group is restricted.

It is desirable that the distance measuring unit 113 and the distance comparing unit 114 should be achieved by the processor 302 of the terminal device 3, those units may be achieved by the processor 204 of the sewing-machine main unit 2. When the processor 302 of the terminal device 3 achieves the distance measuring unit 113 and the distance comparing unit 114, the detection signals of the movement detecting unit 112 are transmitted to the sewing-machine main unit 2 via the wireless communication device 314 of the terminal device 3.

In this case, the accumulated value output by the distance measuring unit 113 indicates a distance of the terminal device 3 apart from the sewing-machine main unit 2 with the sewing-machine main unit 2 being as an origin by the following scheme. This also indicates a distance of the operator who has the terminal device 3 apart from the sewing-machine main unit 2 with the sewing-machine main unit 2 being as an origin.

Figure 4:
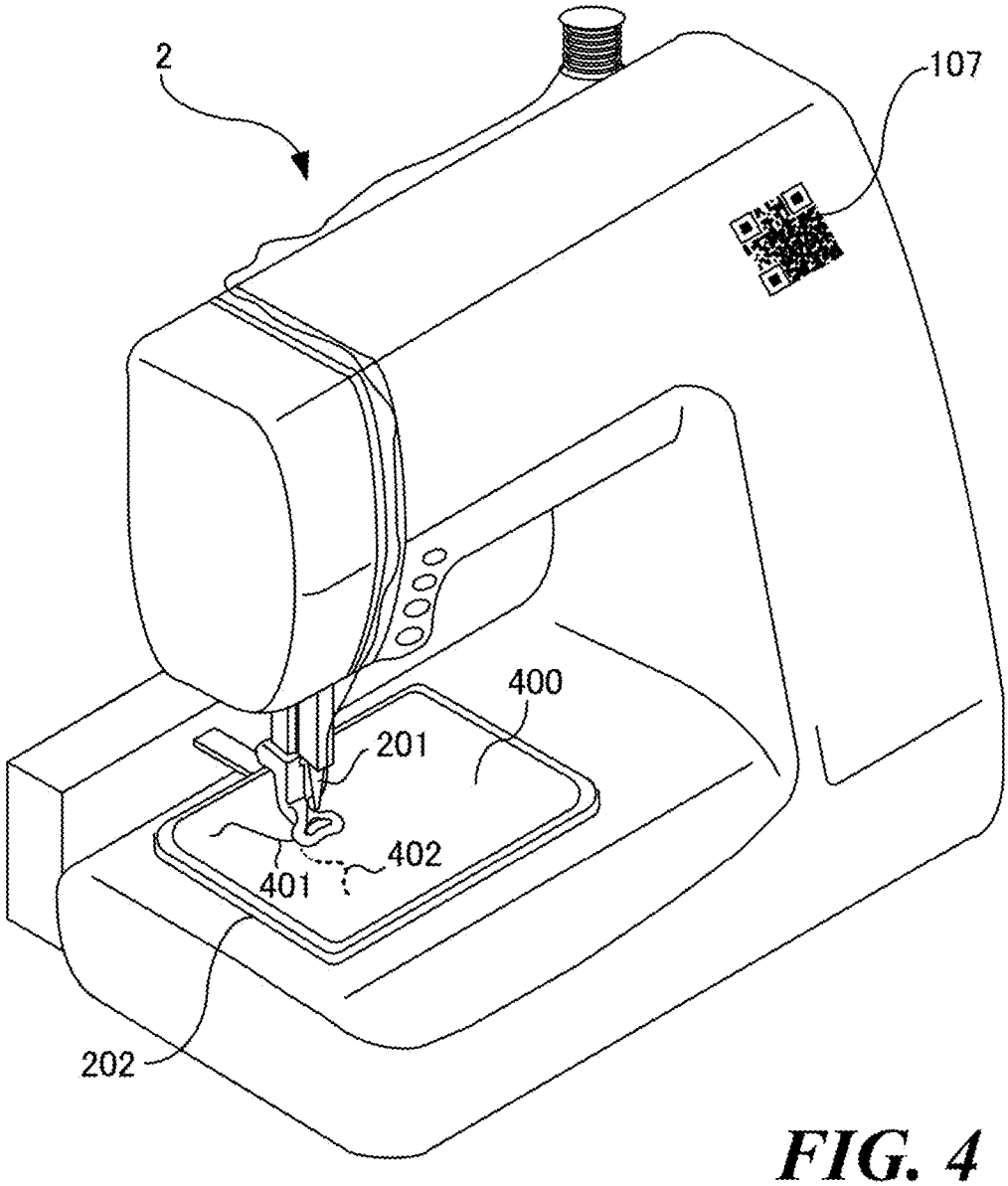
FIG. 4 is an exemplary diagram illustrating a surface of the sewing machine.

As for the scheme, first, as illustrated in FIG. 4, the information providing part 107 of the sewing-machine main unit 2 is a bar code, a two-dimensional code, or an RFID tag containing specifying information. When the bar code or the two-dimensional code is applied, it is printed or pasted on the casing of the sewing-machine main unit 2, or when the sewing-machine main unit 2 is provided with a display unit like a liquid crystal display, such information is displayed on the display unit.

In order to read the specifying information from the information providing part 107 with the short-distance information acquiring unit 313 of the terminal device 3 being activated, it is necessary for the information providing part 107 and the short-distance information acquiring unit 313 to be located within a short-distance range, and the operator needs to be located within a short distance from the sewing-machine main unit 2 since the information providing part 107 is displayed on the sewing-machine main unit 2. That is, the operator must be located at the position where the sewing-machine main unit 2 is present.

The origin setting unit 109 includes the processor 302 of the terminal device 3, and when the short-distance information acquiring unit 313 acquires information and it is confirmed that the acquired information is the specifying information, the origin setting unit 109 activates the movement detecting unit 112, and starts detecting the movement direction and the displacement amount for each sampling cycle.

That is, upon acquisition of the specifying information, the origin setting unit 109 sets the original accumulated value to zero, and causes the movement detecting unit 112, the distance measuring unit 113, and the distance comparing unit 114 to start generating the accumulated value. Hence, when the information providing part 107 displayed on the sewing-machine main unit 2 is accessed by the short-distance information acquiring unit 313, the accumulated value indicating the apart distance is initialized to zero, and the accumulated value is measured. The apart distance between the sewing-machine main unit 2 and the operator is to be measured with the initial position when the operator is located at the position where the sewing-machine main unit 2 is present.

That is, the specifying information is information that assures that the operator is, at the beginning, at the position where the sewing machine is present, and the detail thereof is not limited to any particular detail. The origin setting unit 109 includes the storage 303 and the memory 304, stores true and correct information beforehand, checks the information acquired by the short-distance information acquiring unit 313 with the true and correct information, and when the acquired information matches the true and correct information, activates the movement detecting unit 112 to start measuring the apart distance between the sewing-machine main unit 2 and the operator.

Moreover, information other than the assurance that the operator is, at the beginning, at the position where the sewing-machine main unit 2 is present may be added to the specifying information. For example, the specifying information may be connection information like a MAC address of the sewing-machine main unit 2 necessary to establish a communication between the sewing-machine main unit 2 and the terminal device 3. When the specifying information is the connection information, the terminal-side communication control unit 111 achieved by the processor 302 and the wireless communication device 314 receives the specifying information from the short-distance information acquiring unit 313, and establishes the communication with the sewing-machine main unit 2 for an operation via the terminal device 3 by utilizing this specifying information.

At this time, upon the successful communication establishment, the origin setting unit 109 may start generating the accumulated value by the movement detecting unit 112, the distance measuring unit 113, and the distance comparing unit 114, and a checking with the true and correct information is unnecessary in this case. However, in view of a possibility such that the operator moves around while the communication establishment is attempted, it is desirable to start generating the accumulated value based on the checking with the true and correct information.

Figure 5:
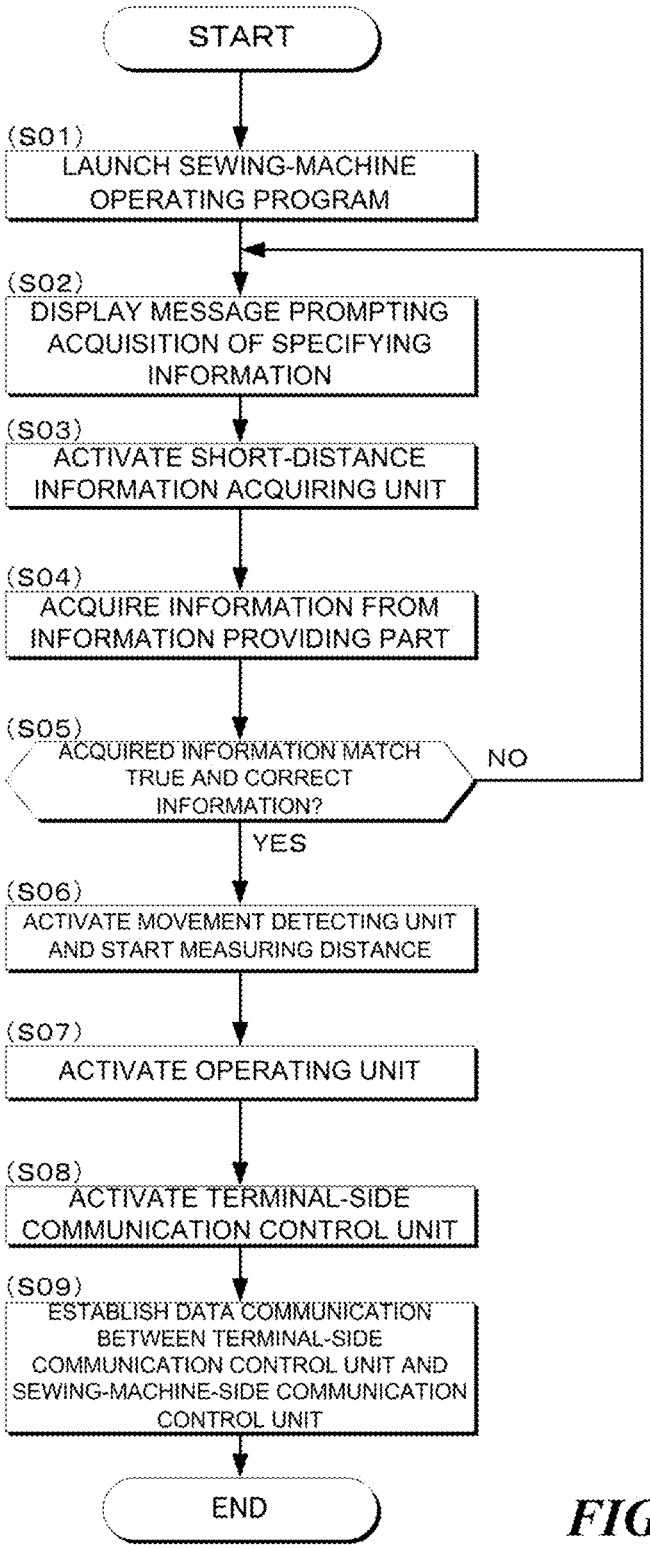
FIG. 5 is a flowchart illustrating an example of operating enabling preparation action of the sewing machine.

FIG. 5 is a flowchart illustrating an example operation-enabling-preparation action by such a sewing machine 1. Note that the sewing-machine operating program 322 is based on an example case in which the terminal device is operated as the operating unit 101, the command generating unit 102, the command transmitting unit 103, the short-distance information acquiring unit 313, the origin setting unit 109, the terminal-side communication control unit 111, the movement detecting unit 112, the distance measuring unit 113, the distance comparing unit 114, and the function restricting unit 115, but the present disclosure is not limited to this case as already described above.

When the operator launches the sewing-machine operating program 322 (step S01), the origin setting unit 109 displays, on the man-machine interface 311 of the terminal device 3, a message prompting to acquire the specifying information from the information providing part 107 in front of the sewing machine (step S02), and activates the short-distance information acquiring unit 313 (step S03). When the information providing part 107 is a two-dimensional code or a bar code, a camera is activated. When the information providing part 107 is an RFID tag, an RFID reader is activated.

When the operator acquires the information from the information providing part 107 using the short-distance information acquiring unit 313 (step S04), the origin setting unit 109 checks the information acquired by the short-distance information acquiring unit 313 with the true and correct information (step S05). Based on the checking, when the information does not match the true and correct information (step S05: NO), the process returns to the step S02.

When the information acquired by the short-distance information acquiring unit 313 matches the true and correct information (step S05: YES), the origin setting unit 109 activates the movement detecting unit 112 to start measuring the distance (step S06), and activates the operating unit 101 for an operation to the sewing machine (step S07). The term activation of the operating unit 101 is to display the operation buttons for the sewing-machine main unit 2 on the man-machine interface 311, and to receive the depression of the button. The above processes are a specifying information acquiring step.

Moreover, the origin setting unit 109 activates the terminal-side communication control unit 111 (step S08), and the terminal-side communication control unit 111 establishes the communication enabling a data communication with the sewing-machine-side communication control unit 110 using the specifying information acquired by the short-distance information acquiring unit as connection information (step S09).

Figure 6:
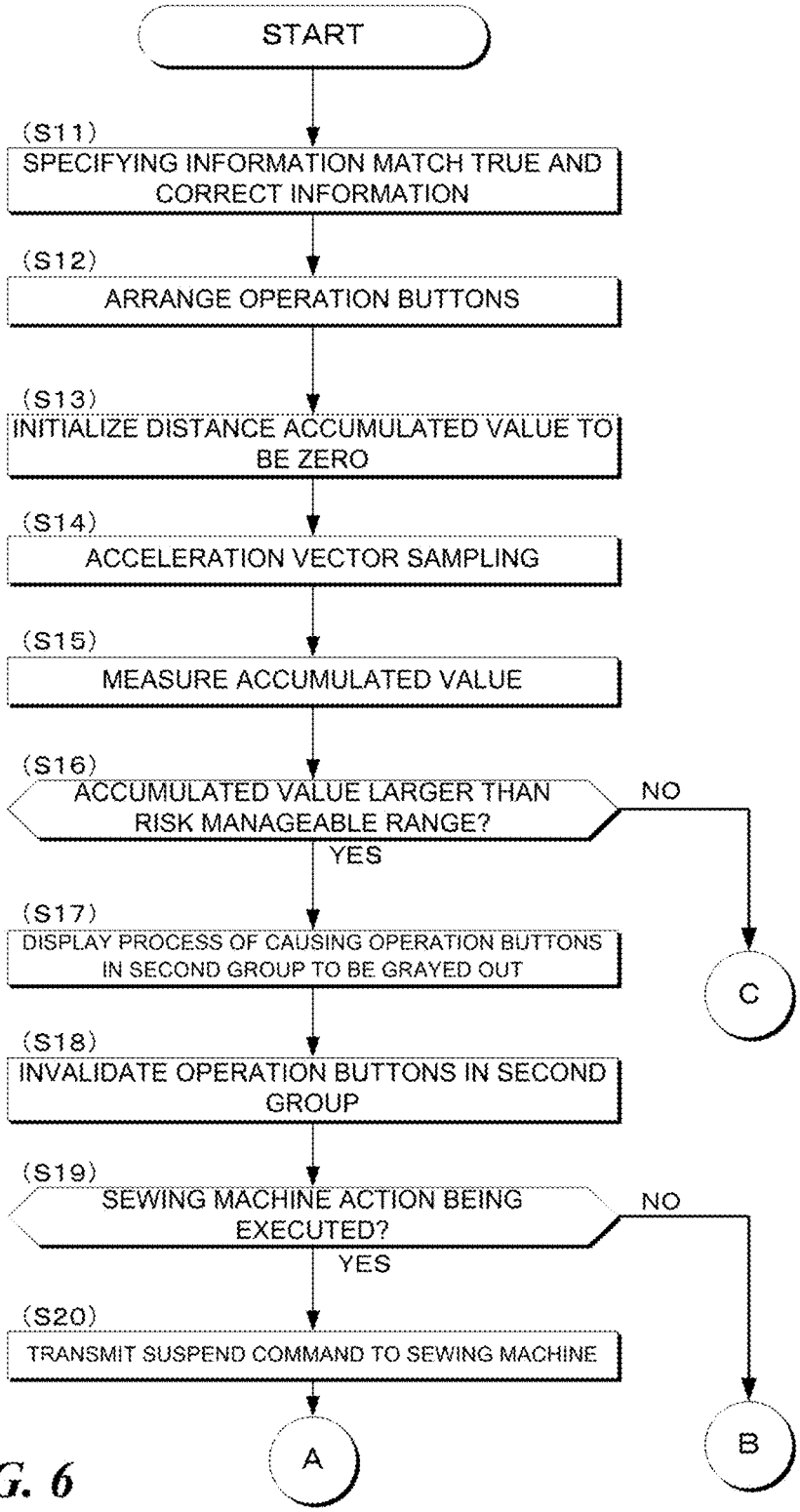
FIG. 6 is a first half of a flowchart illustrating an example sewing-machine operating action under a function restricting control on the sewing machine.
Figure 7:
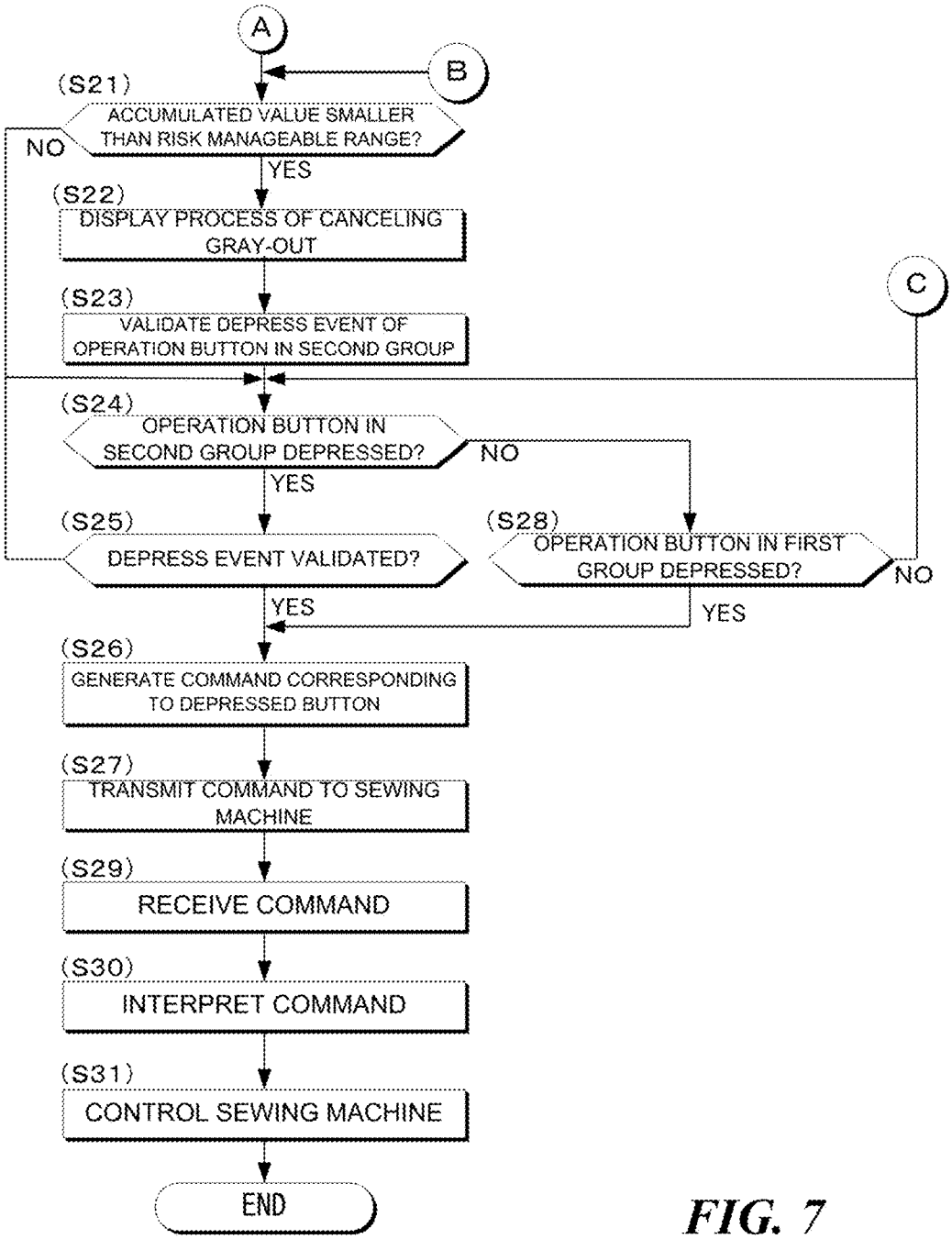
FIG. 7 is in a second half of a flowchart illustrating the example sewing-machine operating action under the function restricting control on the sewing machine.

FIGS. 6 and 7 are each a flowchart illustrating an example sewing-machine operating action under such a function restricting control on the sewing machine 1. Although an example case will be described in which the terminal device 3 is provided with the function restricting unit 115 that interrupts the display of the operation buttons of the operating unit 101, the present disclosure is not limited to this case as already described above.

First, when the specifying information matches the true and correct information (step S11), the operating unit 101 arranges the operation buttons in the first group and in the second group (step S12). Moreover, the distance measuring unit 113 initializes distance accumulated value to zero (step S13). Next, the activated movement detecting unit 112 performs sampling on the acceleration vector (step S14), and the distance measuring unit 113 sets the scalar of the synthetic vector of each acceleration vector having undergone the sampling as the accumulated value (step S15). The above processes are a distance measuring step.

The distance comparing unit 114 compares the accumulated value with the risk manageable range E1 stored beforehand as a distance comparing step (step S16). Based on the comparison, when the accumulated value is larger than the risk manageable range E1 (step S16: YES), the function restricting unit 115 performs, as a function restricting step, a display process of causing the operation buttons in the second group to be grayed out on the man-machine interface 311 (step S17), and invalidates a depress event of the operation button in the second group (step S18). Typically, even if operation signals are input, a determination on whether or not the depress event of the operation button in the second group occurs is not performed.

Moreover, based on the comparison, when the accumulated value is larger than the risk manageable range E1 (step S16: YES) and the action of the sewing-machine main unit 2 accomplished when the operation button in the second group is depressed is being executed (step S19: YES), the function restricting unit transmits, to the sewing machine, a suspend command that suspends the operation of the sewing-machine main unit 2 (step S20).

In contrast, when the distance comparing unit 114 compares the accumulated value with the risk manageable range E1 (step S21), and when the accumulated value becomes smaller than the risk manageable range E1 (step S21: YES), the function restricting unit 115 performs a display process of canceling the gray-out of the operation buttons in the second group on the man-machine interface 311 (step S22), and validates the depress event of the operation buttons in the second group (step S23). Typically, when operation signals are input in accordance with this action, a determination on whether or not the depress event of the operation button in the second group occurs is performed.

When the button in the second group is depressed (step S24: YES) and when the depress event of the operation button in the second group is determined as valid (step S25: YES), the command generating unit 102 generates the command corresponding to the depressed button (step S26), and the terminal-side wireless communication unit 111 transmits the generated command to the sewing-machine main unit 2 (step S27). Moreover, when the operation button in the first group is depressed (step S28: YES), the command generating unit 102 generates, without the interruption by the function restricting unit 115, the command corresponding to the depressed button (step S26), and the terminal-side wireless communication unit 111 transmits the generated command to the sewing-machine main unit 2 (step S27).

Subsequently, at the sewing-machine main unit 2, the sewing-machine-side wireless communication unit receives the command (step S29), the command interpreting unit interprets the command (step S30), and the command executing unit 106 controls the sewing machine in accordance with the interpreting result (step S31).

In this case, a scheme of grasping the positional relationship between the sewing-machine main unit 2 and the operator within or out of the radiowave range between the sewing machine and the RFID and the WiFi may be possible. However, the radiowave range of the RFID is substantially 1 m, and the radiowave range of the WiFi is substantially 20 m. That is, the radiowave range of the RFID and that of the WiFi with reference to the sewing-machine main unit 2 do not match the risk manageable range E1. Moreover, the sewing-machine main unit 2 is typically installed inside a building, etc., and the GPS is mostly useless to grasp the precise position of the operator.

Figure 9A:
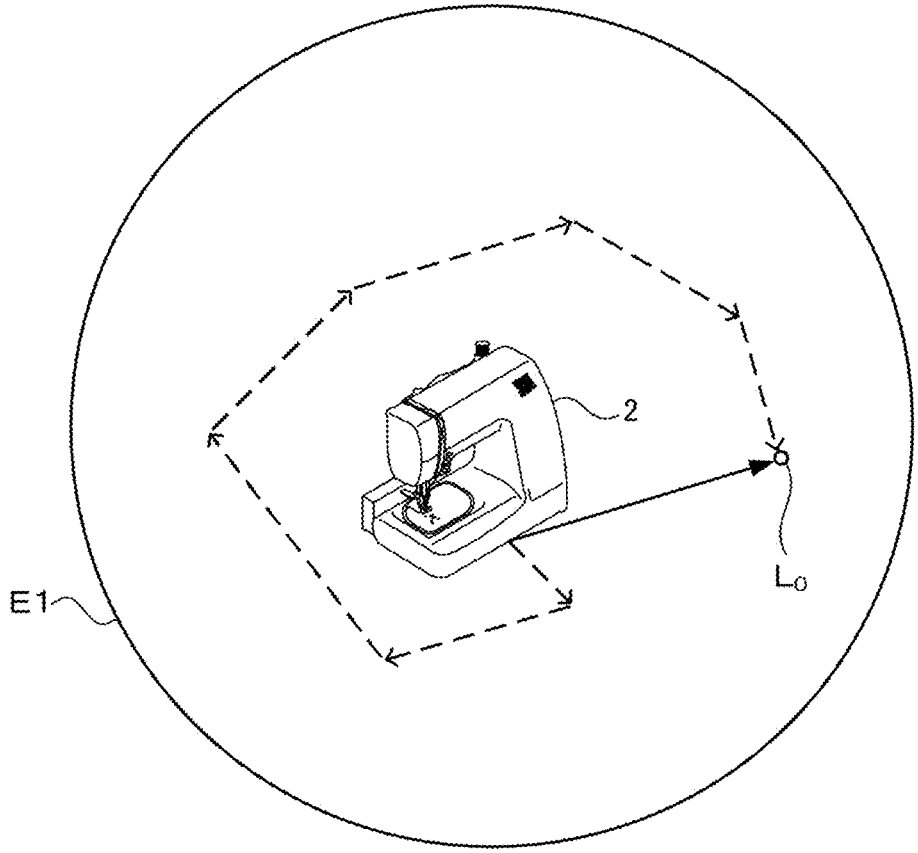
FIGS. 9A and 9B are each an exemplary diagram illustrating a risk manageable range.
Figure 9B:
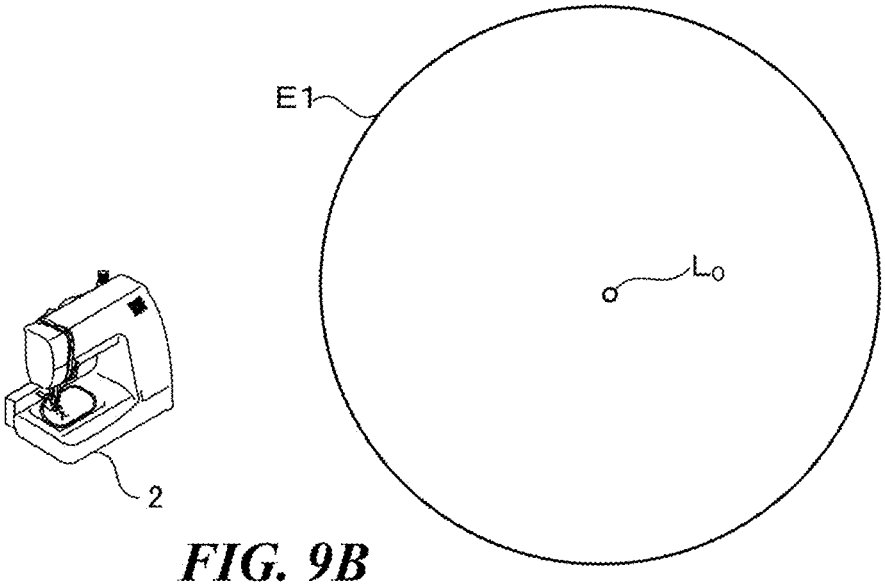

Moreover, since the acceleration sensor and the gyro sensor are capable of accumulating the distance, those can match the risk manageable range E1. However, because the original absolute positional coordinate of the operator when the movement detection starts is unknown, as illustrated in FIG. 9B, the risk manageable range E1 is to be set at a location irrelevant to the sewing machine. This does not enable an operation to the sewing-machine main unit 2 by the terminal device 3 while managing the risk. For example, when the risk manageable range E1 is 5 m with the sewing machine being as an origin, and an initial position Lo of the operator when the movement detection starts is 9 m apart from the sewing machine, the risk manageable range E1 is to be set from the position apart by 4 m from the sewing machine and to the position apart by 14 m from the sewing machine, and this permits the operator to remotely operate the sewing machine under a condition in which the risk is not manageable.

Figure 8A:
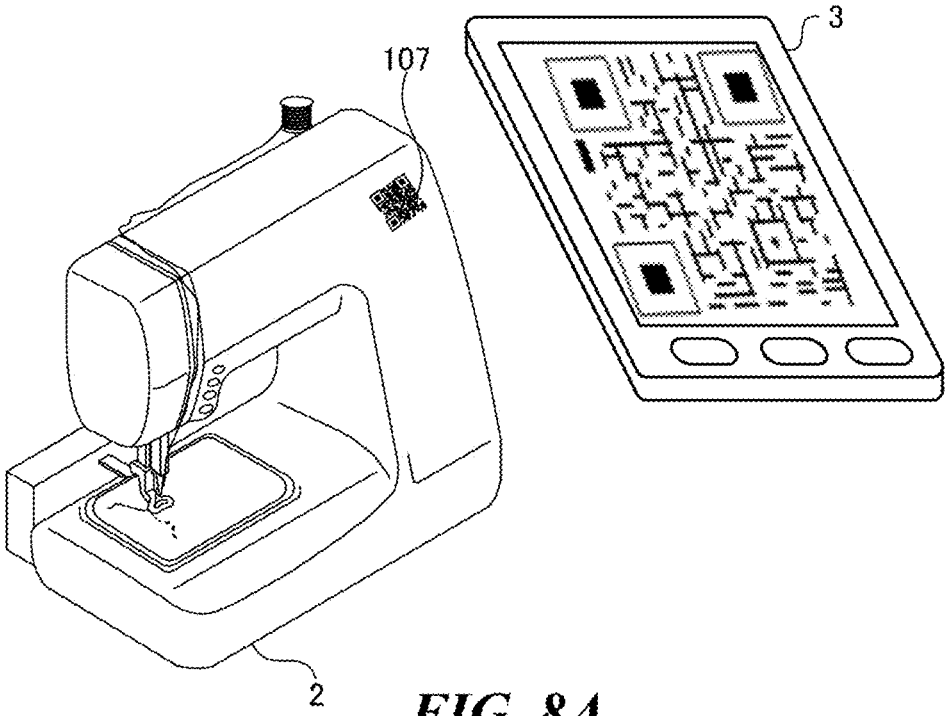
FIGS. 8A and 8B are each an exemplary diagram illustrating a result in accordance with the position of an operator at a time of acquiring the specific information.
Figure 8B:
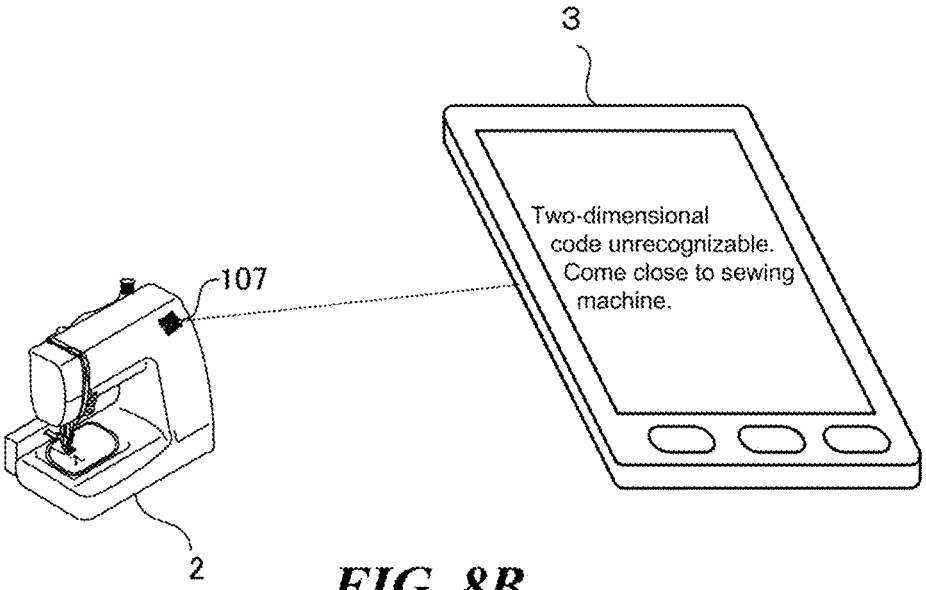

According to the sewing machine 1 of this embodiment, however, as illustrated in FIGS. 8A, and 8B, if the operator does not come in front of the sewing-machine main unit 2, the short-distance information acquiring unit 313 is not capable of acquiring the specifying information from the information providing part 107. In other words, the sewing machine 1 is capable of sensing that the operator is located in front of the sewing-machine main unit 2 by acquiring the specifying information, and starts the measurement of the apart distance from this sensing timing, and thus, as illustrated in FIG. 9A, the positional relationship between the risk manageable range E1 and the operator with the sewing-machine main unit 2 being as an origin can be grasped.

As described above, this sewing machine 1 is provided with the terminal device 3. This terminal device 3 includes the operating unit 101, the distance measuring unit 113, the distance comparing unit 114, and the function restricting unit 115. A remote operation to the sewing-machine main unit 2 is input in the operating unit 101. The distance measuring unit 113 calculates the apart distance from the sewing-machine main unit 2. The distance comparing unit 114 compares the apart distance with the prescribed distance that is set beforehand from the sewing-machine main unit 2. That is, the prescribed distance is the risk manageable range E1. The function restricting unit 115 restricts the function of the remote operation from the operating unit 101 in accordance with the comparison result by the distance comparing unit 114.

This enables the sewing machine 1 to grasp the position of the operator with the sewing-machine main unit 2 being as an origin, and to freely confirm whether or not the operator is within the risk manageable range. Accordingly, this sewing machine 1 can provide a risk management that ensures a certain safeness even if the mechanical components of the sewing-machine main unit 2 are actuated, and also an advanced operation environment for the sewing machine using the terminal device 3.

Moreover, the terminal device 3 includes the short-distance information acquiring unit 313 and the movement detecting sensor 312. The short-distance information acquiring unit 313 acquires the specifying information recorded on the sewing-machine main unit 2, and the movement detecting sensor 312 detects the movement of the terminal device 3. Moreover, the terminal device 3 calculates, in the distance measuring unit 113, the apart distance from the detection result of the movement detecting sensor 312 with the position where the short-distance information acquiring unit 313 acquires the specifying information being as the position of the sewing-machine main unit 2.

Hence, in order to cause the terminal device 3 to acquire the specifying information, the operator needs to be once located in front of the sewing machine, i.e., the information providing part 107 and the short-distance information acquiring unit 313 function as means for causing the operator to be once located in front of the sewing machine. This enables a grasp of a state in which the operator is located in front of the sewing machine by acquisition of the specifying information, and the position of the operator relative to the initial position can be measured at this grasp timing.

Accordingly, since the position of the operator with the sewing-machine main unit 2 being as an origin can be further precisely grasped, and whether the operator is within or out of the risk manageable range can be freely grasped, this sewing machine 1 enables a further risk management for assuring a certain safeness even if the mechanical components of the sewing-machine main unit 2 are actuated, and provides an advanced operation environment for the sewing machine using the terminal device 3.

The short-distance information acquiring unit 313 is a camera or a short-distance wireless communication device, and the specifying information is indicated as the bar code, the two-dimensional code, or the RFID tag provided on the sewing-machine main unit 2. This further surely causes the operator to be once located in front of the sewing machine.

Moreover, the specifying information is necessary information to communicate with the sewing-machine main unit 2, and the sewing-machine main unit 2 and the terminal device 3 include the terminal-side communication control unit 111 and the sewing-machine-side communication control unit 110, respectively, that establish a communication between the sewing-machine main unit 2 and the terminal device 3 based on the specifying information when the short-distance information acquiring unit 313 acquires the specifying information. Accordingly, if the operator is not located in front of the sewing-machine main unit 2, the command in accordance with the operation cannot be transmitted to the sewing machine, enabling a redundant risk management.

The function restricting unit 115 causes the control unit to interpret the command and execute the control when the apart distance is within the prescribed distance at the distance comparing unit 114, but does not transmit the command to the control unit when the apart distance exceeds the prescribed distance. In order to not transmit the command to the control unit, a control such that no operation is accepted so as not to generate the command, not to transmit the command, and not to transmit the command to the command executing unit 106 in accordance with the interpreting result of the command may be adopted.

The operating unit 101 receives the remote operation other than the sewing operation of causing the needle 201 to reciprocate. That is, this sewing machine 1 is capable of managing the risk by classifying, in accordance with the risk level, the operations into the first group that enables an operation regardless of whether or not the operator is within the risk manageable range, the second group that enables an operation when the operator is within the risk manageable range even if the operator is apart from the sewing machine, and the third group that forces the operator to directly operate the sewing-machine main unit 2 and does not allow the operator to move apart therefrom.

Although the terminal device 3 in this sewing machine 1 is realizable using the computer 301 that executes the sewing-machine operating program 322, the terminal device 3 may be realized by a special-purpose circuit, and the special-purpose circuit may serve as the operating unit 101, the command generating unit 102, the command transmitting unit 103, the short-distance information acquiring unit 313, the origin setting unit 109, the terminal-side communication control unit 111, the movement detecting unit 112, the distance measuring unit 113, the distance comparing unit 114, and the function restricting unit 115.

When the terminal device 3 is realized by the computer 301, the sewing-machine operating program 322 may cause the computer 301 to execute the distance measuring step, the distance comparing step, and the function restricting step. In the distance measuring step, the apart distance of the terminal device 3 from the sewing-machine main unit 2 is calculated. In the distance comparing step, the apart distance is compared with the prescribed distance set in advance relative to the sewing-machine main unit 2 is calculated. In the function restricting step, in accordance with the comparison result in the distance comparing step, the function for the remote operation to the sewing-machine main unit 2 via the operating unit 101 may be restricted.

Second Embodiment

Next, a sewing machine according to a second embodiment will be described in detail with reference to the drawings. The same component and the same function as those of the first embodiment will be denoted by the same reference numeral, and the detailed description will be omitted.

As illustrated in FIG. 10, the function restricting unit 115 has an operation kind list, classifies the risk manageable range E1 into two distances in addition to within or out of the risk manageable range E1 to distinguish the function restriction at each distance. That is, the operation kind list stores, for each operation, a combination of an out-of-risk-manageable-range function restricting scheme, a within-risk-manageable-inner-boundary-range function restricting scheme, and a within-risk-manageable-outer-boundary-range function restricting scheme.

The function restricting schemes at the location out of the risk manageable range are stored in the out-of-risk-manageable-range function restricting scheme. The function restriction schemes at the distance near the sewing machine within the risk manageable range E1 are stored in the within-risk-manageable-inner-boundary-range function restricting scheme. The function restriction scheme at the distance apart from the sewing-machine main unit 2 within the risk manageable range E1 are stored in the within-risk-manageable-outer-boundary-range function restricting scheme.

The risk manageable range E1 is, for example, 5 m from the sewing-machine main unit 2, a risk-manageable inner-boundary range E2 is within 3 m from the sewing machine, and a risk-manageable outer-boundary range E3 is within a range between 3 to 5 m from the sewing machine.

In the case of the operation in the second group that permits an operation within the risk manageable range E1, when the operator is in the risk-manageable outer-boundary range E3, the function restricting unit 115 displays an alert message on the man-machine interface 311, and accepts the operation after the operator checks the alert message. That is, the function restricting unit 115 does not assume the risk management capability of the user without exception, but requests the operator to check the own risk management capability at the location apart from the sewing-machine main unit 2.

Figure 11:
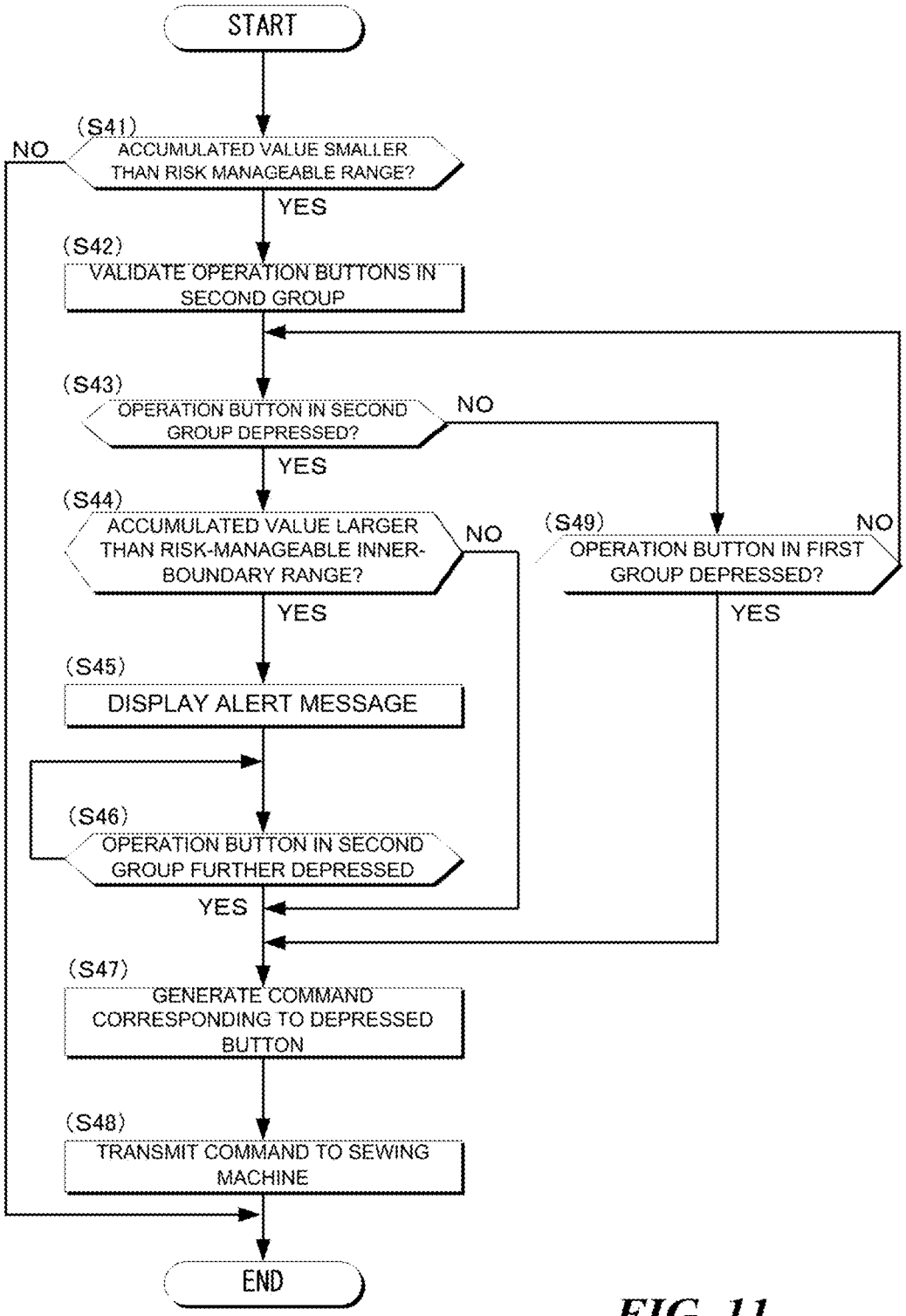
FIG. 11 is a flowchart illustrating another example sewing-machine operating action under the function restricting control on the sewing machine.

FIG. 11 is a flowchart illustrating an example sewing-machine operating action under such a function restricting control on the sewing machine 1. The distance comparing unit 114 compares, as the distance comparing step, the accumulated value with the risk manageable range E1 stored beforehand (step S41). Based on the comparison, when the accumulated value is smaller than the risk-manageable inner-boundary range E2 (step S41: YES), the operation buttons in the second group are validated (step S42).

When the operator depresses the operation button in the second group (step S43), the distance comparing unit 114 compares the accumulated value with the risk-manageable inner-boundary range E2 (step S44). Based on the comparison, when the accumulated value is larger than the risk-manageable inner-boundary range E2 (step S44: Yes), the function restricting unit 115 displays the alert message on the man-machine interface 311 (step S45), and when the operator further depresses the operation button in the second group (step S46: YES), the command generating unit 102 generates the command corresponding to the depressed button (step S47), and the terminal-side wireless communication unit 111 transmits the generated command to the sewing-machine main unit 2 (step S48).

In contrast, based on the comparison, when the accumulated value is smaller than the risk-manageable inner-boundary range E2 (step S44: NO), the command generating unit 102 generates the command corresponding to the depressed button (step S47), and the terminal-side wireless communication unit transmits the generated command to the sewing-machine main unit 2 (step S48).

Moreover, when the operation button in the first group is depressed (step S49: YES), the command generating unit 102 generates, without an interruption by the function restricting unit 115, the command corresponding to the depressed button (step S47), and the terminal-side wireless communication unit 111 transmits the generated command to the sewing-machine main unit 2 (step S48).

As described above, the prescribed distance involves the risk manageable range E1 that is a first prescribed distance, and the risk-manageable inner-boundary range E2 that is a second prescribed distance shorter than the first prescribed distance.

Next, the function restricting unit 115 does not transmit the command corresponding to the remote operation to the sewing-machine main unit 2 when the apart distance between the sewing-machine main unit 2 and the operator exceeds the risk manageable range E1. Moreover, when the apart distance is within the risk manageable range E1 and exceeds the risk-manageable inner-boundary range E2, the function restricting unit 115 gives the alert to the remote operation, and then transmits the command corresponding to remote operation to the sewing-machine main unit 2 via the terminal-side wireless communication unit 111. Furthermore, when the apart distance is within the risk-manageable inner-boundary range E2, the command corresponding to remote operation is transmitted to the sewing-machine main unit 2 via the terminal-side wireless communication unit 111.

This enables the sewing machine to request the operator to check the own risk management capability at the location apart from the sewing-machine main unit 2, enabling a further precise risk management.

Modified Example

A modified example of the sewing machine 1 according to the second embodiment will be described in detail with reference to the drawings. The same component and same function as those of the second embodiment will be denoted by the same reference numeral, and the detailed description will be omitted.

The function restricting unit 115 displays the alert message on the man-machine interface 311, but as for the display timing, regardless of the operation given by the operator, when the operator enters a risk-manageable outer-boundary range E3, i.e., when the apart distance is within the risk manageable range but is out of the risk-manageable inner-boundary range E2, the alert message is displayed without exception. Moreover, the function restricting unit 115 actuates the vibrator and the speaker, etc., of the terminal device 3 in addition to displaying the alert message, and gives an alert by vibration and sound.

Figure 12:
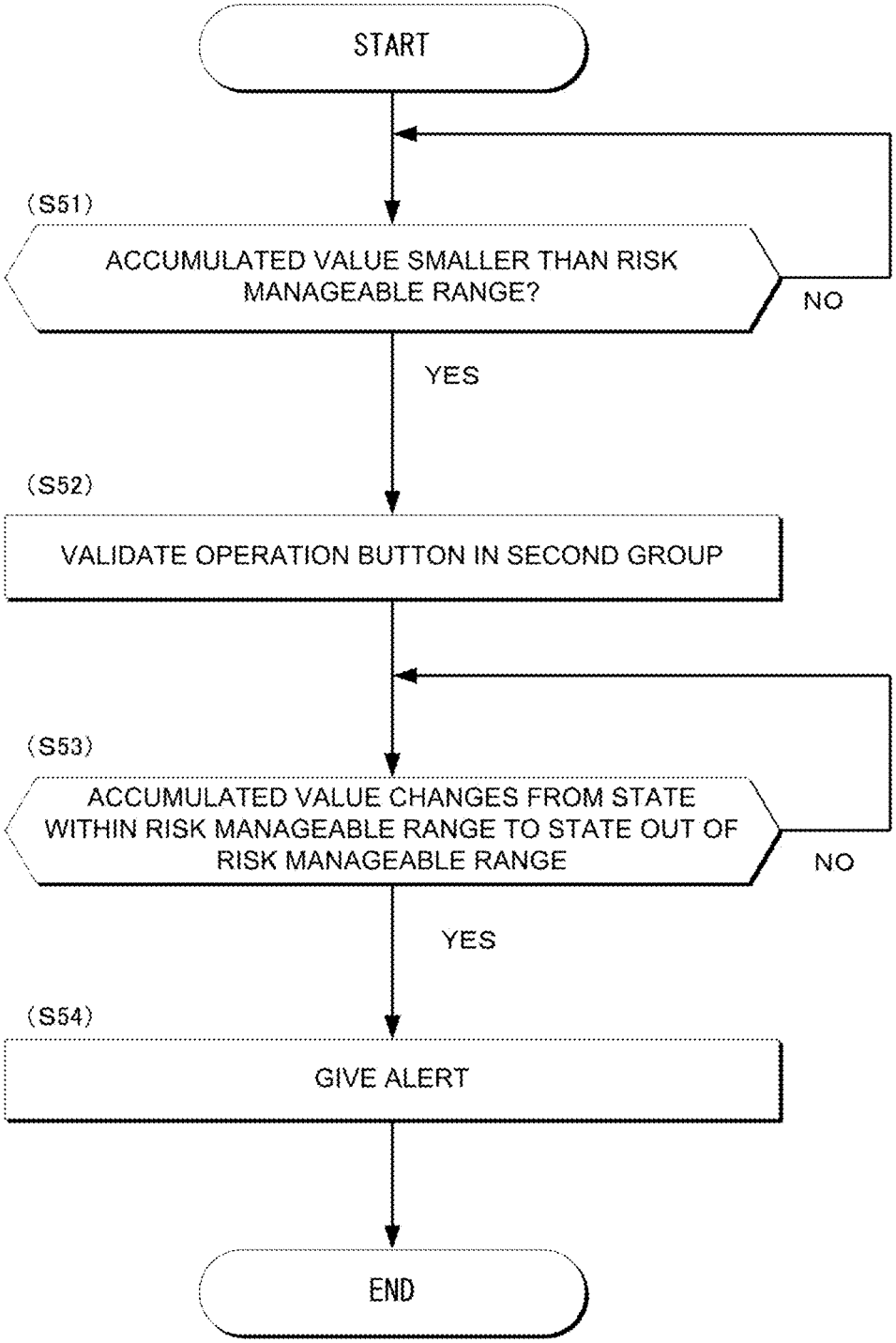
FIG. 12 is a flowchart illustrating the other example sewing-machine operating action under the function restricting control on the sewing machine.

FIG. 12 is a flowchart illustrating an example sewing-machine operating action under such a function restricting control on the sewing machine 1. The distance comparing unit 114 compares, as the distance comparing step, the accumulated value with the risk manageable range E1 stored beforehand (step S51). Based on the comparison, when the accumulated value is smaller than the risk manageable range E1 (step S51: YES), the operation button in the second group is validated (step S52).

Furthermore, the distance comparing unit 114 compares the accumulated value with the risk-manageable inner-boundary range E2 (step S53). Based on the comparison, when the accumulated value changes from the state smaller than the risk-manageable inner-boundary range E2 to the state larger than such a range (step S53: YES), the function restricting unit 115 gives the alert (step S54).

As described above, according to this sewing machine 1, the boundary between the risk-manageable outer-boundary range E3 shorter than the risk manageable range E1 and the risk-manageable inner-boundary range E2 is defined as an alert distance, and when the position of the operator becomes apart and equal to or larger than the alert distance, the alert is given. That is, the function restricting unit 115 informs the operator of the operator going out of the risk manageable range E1, thereby avoiding an occasion in which the risk management by the operator becomes unable, and also avoiding an unexpected suspension of the action of the sewing machine by the operator.

Other Embodiments

Although the embodiments of the present disclosure have been described above, various omissions, replacements, and modifications can be made thereto without departing from the scope of the present disclosure. Such an embodiment and modified forms thereof are within the scope of the present disclosure, and also within the scope of the invention as recited in appended claims and the equivalent range thereto.

What is claimed is:

1. A non-transitory computer readable medium storing a sewing-machine operating program causing a terminal device that comprises an operating unit to execute:

a distance measuring process of calculating an apart distance of the terminal device from a sewing machine;

a distance comparing process of comparing the apart distance with a prescribed distance set beforehand from the sewing machine; and a function restricting process of restricting a function of a remote operation via the operating unit to the sewing machine in accordance with a comparison result in the distance comparing process.

2. The non-transitory computer readable medium storing the sewing-machine operating program according to claim 1, wherein:

the terminal device further comprises:

an information acquiring unit that acquires specifying information recorded on the sewing machine; and a movement detecting sensor that detects a movement of the terminal device, and in the distance measuring process, the apart distance is calculated from a detection result of the movement detecting sensor with a position where the information acquiring unit acquires the specifying information being as a position of the sewing machine.

3. The non-transitory computer readable medium storing the sewing-machine operating program according to claim 2, wherein:

the information acquiring unit is a camera or a short-distance wireless communication device; and the specifying information is indicated as a bar code, a two-dimensional code, or an RFID tag provided on the sewing machine.

4. The non-transitory computer readable medium storing the sewing-machine operating program according to claim 2, further causing the terminal device to execute a communication establishing process of establishing a communication between the sewing machine and the terminal device based on the specifying information when the information acquiring unit acquires the specifying information.

5. The non-transitory computer readable medium storing the sewing-machine operating program according to of claim 1, wherein:

the terminal device further comprises a communication unit; and in the function restricting process, when the apart distance is within the prescribed distance, a command corresponding to the remote operation is transmitted to the sewing machine via the communication unit; and when the apart distance exceeds the prescribed distance, a command corresponding to the remote operation is not transmitted to the sewing machine.

6. The non-transitory computer readable medium storing the sewing-machine operating program according to claim 1, wherein:

the terminal device further comprises a communication unit;

the prescribed distance comprises a first prescribed distance and a second prescribed distance shorter than the first prescribed distance; and in the function restricting process, when the apart distance exceeds the first prescribed distance, a command corresponding to the remote operation is not transmitted to the sewing machine;

when the apart distance is within the first prescribed distance and exceeds the second prescribed distance, after an alert to the remote operation is given, a command corresponding to the remote operation is transmitted to the sewing machine via the communication unit; and when the apart distance is within the second prescribed distance, a command corresponding to the remote operation is transmitted to the sewing machine via the communication unit.

7. The non-transitory computer readable medium storing the sewing-machine operating program according to claim 1, wherein:

in the distance comparing process, the apart distance is compared with an alert distance shorter than the prescribed distance; and the sewing-machine operating program further causes the terminal device to execute an alerting process of giving an alert when the apart distance becomes equal to or larger than the alert distance.

8. A sewing machine comprising a terminal device, wherein the terminal device comprises:

an operating unit in which a remote operation to the sewing machine is input;

a distance measuring unit that calculates an apart distance from the sewing machine;

a distance comparing unit that compares the apart distance with a prescribed distance that is set beforehand from the sewing machine; and a function restricting unit that restricts a function of the remote operation via the operating unit in accordance with a comparison result by the distance comparing unit.

9. The sewing machine according to claim 8, wherein:

the terminal device further comprises:

an information acquiring unit that acquires specifying information recorded on the sewing machine; and a movement detecting sensor that detects a movement of the terminal device, and the distance measuring unit calculates the apart distance from the detection result of the movement detecting sensor with the position where the information acquiring unit acquires the specifying information being as a position of the sewing machine.

10. The sewing machine according to claim 9, wherein:

the information acquiring unit is a camera or a short-distance wireless communication device; and the specifying information is indicated as the bar code, the two-dimensional code, or the RFID tag provided on the sewing machine.

11. The sewing machine according to claim 9, wherein the sewing machine and the terminal device comprise respective communication control units that establish a communication between the sewing machine and the terminal device based on the specifying information when the information acquiring unit acquires the specifying information.

12. A terminal device comprising:

an operating unit in which a remote operation to a sewing machine is input;

a distance measuring unit that calculates an apart distance from the sewing machine;

a distance comparing unit that compares the apart distance with a prescribed distance that is set beforehand from the sewing machine; and a function restricting unit that restricts a function of the remote operation via the operating unit in accordance with a comparison result by the distance comparing unit.

13. The terminal device according to claim 12, further comprising:

an information acquiring unit that acquires specifying information recorded on the sewing machine; and a movement detecting sensor that detects a movement of the terminal device, wherein the distance measuring unit calculates the apart distance from the detection result of the movement detecting sensor with the position where the information acquiring unit acquires the specifying information being as a position of the sewing machine.

14. The terminal device according to claim 13, wherein:

the information acquiring unit is a camera or a short-distance wireless communication device; and the specifying information is indicated as the bar code, the two-dimensional code, or the RFID tag provided on the sewing machine.

15. The terminal device according to claim 13, further comprising a communication control unit that establishes a communication between the sewing machine and the terminal device based on the specifying information when the information acquiring unit acquires the specifying information.

* * * * *